US011584492B1

(12) United States Patent
De Maria

(10) Patent No.: US 11,584,492 B1
(45) Date of Patent: Feb. 21, 2023

(54) DIRECTED THRUST PROPULSION SYSTEM

(71) Applicant: John De Maria, Lakeport, CA (US)

(72) Inventor: John De Maria, Lakeport, CA (US)

( * ) Notice: Subject to any disclaimer, the term of this patent is extended or adjusted under 35 U.S.C. 154(b) by 0 days.

(21) Appl. No.: 17/809,741

(22) Filed: Jun. 29, 2022

Related U.S. Application Data

(60) Provisional application No. 63/340,853, filed on May 11, 2022.

(51) Int. Cl.
*B63H 1/28* (2006.01)
*B63H 5/14* (2006.01)

(52) U.S. Cl.
CPC ..... *B63H 1/28* (2013.01); *B63H 5/14* (2013.01)

(58) Field of Classification Search
CPC ..... B63H 1/28; B63H 5/14
See application file for complete search history.

(56) References Cited

U.S. PATENT DOCUMENTS 442,615 A 12/1890 Dock
3,508,517 A 4/1970 Hannan
4,130,378 A 12/1978 Eichler
4,789,306 A * 12/1988 Vorus ..... B63H 1/26 416/243
6,352,408 B1 3/2002 Kilian
6,866,482 B2 * 3/2005 Han ..... F04D 29/384 416/228
7,989,973 B2 * 8/2011 Birkestrand ..... E02B 9/00 290/43
10,155,575 B2 * 12/2018 Kehr ..... B63H 1/16
2009/0130927 A1 5/2009 Kluge
2009/0226323 A1 * 9/2009 Suzuki ..... B63H 1/26 416/223 R
2018/0057157 A1 * 3/2018 Groninga ..... B64C 27/52
2020/0354033 A1 * 11/2020 Romero Vázquez .... B63H 5/15

FOREIGN PATENT DOCUMENTS

KR 102012013208 A 12/2012

* cited by examiner

*Primary Examiner* — S. Joseph Morano
*Assistant Examiner* — Jovon E Hayes
(74) *Attorney, Agent, or Firm* — Edward S. Sherman

(57) ABSTRACT

A directed thrust propulsion system has a central hub and at least three blades that extends outward at a rake angle between about 20 to 70 degrees. Each blade is shaped as a portion of a cylindrical surface, in which concave side forms the blade face and is facing in direction of thrust generated by rotating the hub. The convex side of the blades minimizes drag in the water that resists forward motion while the concave shape and tilted end portions directs the thrust inward toward the extension of the hub's principal axis rearward. The directed thrust propulsion system may be deployed on inboard and outboard motors for all manner of watercraft to increase efficiency above 10 knots speed.

9 Claims, 4 Drawing Sheets

DIRECTED THRUST PROPULSION SYSTEM

REFERENCE TO RELATED APPLICATIONS

The present application claims the benefit of priority to the US Provisional patent application of the same title that was filed on May 11, 2022, having application Ser. No. 63/340,0853 and is incorporated herein by reference.

SPECIFICATION

Background of Invention

The field of inventions is fluid propulsion systems useful all manner of watercraft, such as without limitation, boats, ships, submarines, and handheld portable propulsion gear for underwater use.

It is generally understood that propeller systems have inherent limitations in efficiency above speeds of about 10 knots.

The objects of the innovation disclosed herein are to overcome these and other limitations of conventional marine propulsion system to increase vessel speeds and improve efficiency of fuel use at all speeds.

The above and other objects, effects, features, and advantages of the present invention will become more apparent from the following description of the embodiments thereof taken in conjunction with the accompanying drawings

SUMMARY OF INVENTION

In the present innovations, a first object is achieved by providing a directed thrust propulsion system for water propulsion, the directed thrust propulsion system comprising a cylindrical hub having a first principal axis that is configured to be coupled in rotary engagement with a drive shaft turned by a motor, a plurality of blades attached to extend in the radial direction away from said hub, each blade having a first portion attached directly to the hub and then terminating at a second portion coupled to the first portion, in which the first and second portions are entirely shaped as section of a cylinder in having a concave side is tilted at an acute angle with respect to the first principal axis such that the principal axis faces the concave side of the first and second cylindrical portions.

A second aspect of the innovations is characterized by such a directed thrust propulsion system for water propulsion further comprising an annular nozzle configured to extend over the rotary path of the blades at least along the projected length of the blade on the hub.

Another aspect of any such innovations are characterized by any such directed thrust propulsion system for water propulsion in which the acute angle of the first portion of each blade is between about 50 to 70 degrees.

Another aspect of any such innovations are characterized by any such directed thrust propulsion system for water propulsion in which the acute angle of the second portion is less than the acute angle of the first portion.

Another aspect of any such innovations are characterized by any such directed thrust propulsion system for water propulsion in which the length of the second portion is at least about 40 to 60% of the length of the first portion.

Another aspect of any such innovations are characterized by any such directed thrust propulsion system for water propulsion in which blade twist angle of about 33 degrees.

Another aspect of any such innovations are characterized by any such directed thrust propulsion system for water propulsion which the radius of curvature of the cylindrical portion of the blades is between about 2000 to 3000 mm.

Another aspect of any such innovations are characterized by any such directed thrust propulsion system for water propulsion in which the radius of curvature of the first and second cylindrical portions are the same.

Another aspect of any such innovations are characterized by any such directed thrust propulsion system for water propulsion in which the ratio of the blade width to the radius of curvature of the cylindrical portion of the blades is between about 30 to 40.

The above and other objects, effects, features, and advantages of the present invention will become more apparent from the following description of the embodiments thereof taken in conjunction with the accompanying drawings.

BRIEF DESCRIPTION OF DRAWINGS

FIG. 2A is a cross-sectional elevation through the central axis of the hub and a blade central axis for an embodiment of the propulsion system whereas

DETAILED DESCRIPTION

Figures 1A, 1B, 1C:
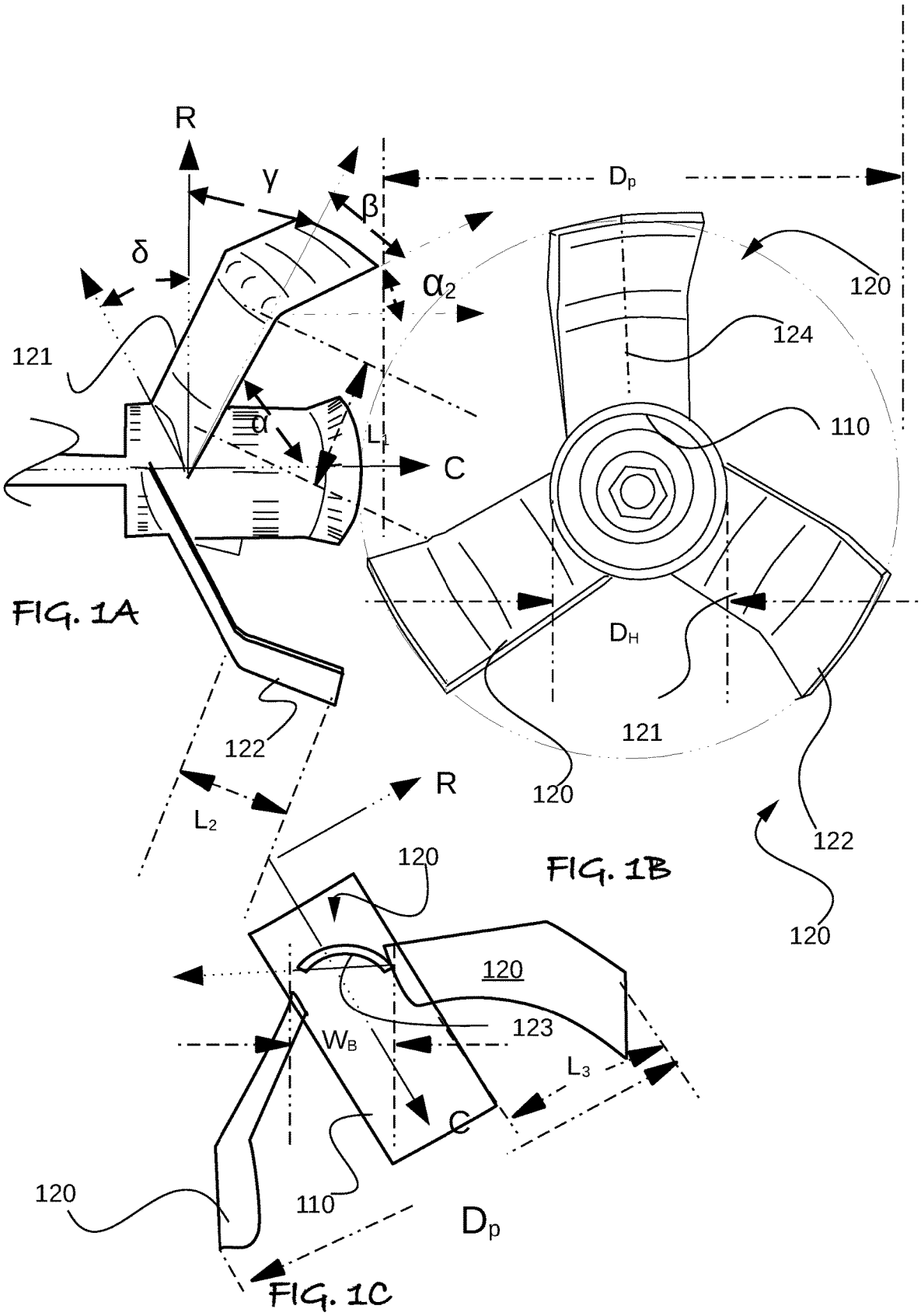
FIG. 1A is an exterior side elevation view of the propulsion system.
FIG. 1B is an exterior end elevation view and FIG. 1C is an exterior top plan view of an R-C plane that places a blade central axis orthogonal to the R-C plane.

Referring to FIGS. 1A through 4, wherein like reference numerals refer to like components in the various views, there is illustrated therein a new and improved Directed Thrust Fluid Propulsion System, generally denominated 100 herein.

In accordance with certain aspects of the present innovations, the Directed Thrust Propulsion System 100 comprises a generally cylindrical hub 110 configured to be rotated by a motor. A plurality of blades 120 extending outward from the cylindrical hub 110. Each blade 120 having a first portion 121 attached directly to the hub and then terminating at a second portion 122 coupled to a distal end of the first portion. The first portion 121 and the second portion 122 are shaped entirely as sections of a cylinder with the concave side 123 facing a principal axis of the hub 110, at an acute angle $\alpha$ (angle less than 90 degrees).

As the hub 110 is rotated about a central axis (labelled C in FIG. 1A-B) that is co-linear with the principal axis of the hub 110, a radial coordinate system having a radial axis R orthogonal to the central axis C is deployed in several of the drawings to clarify the blade 120 and hub 110 shapes and relative orientations using the references numbers and letters that follow.

The blade's 120 first portion 121 may have the concave side 123 being disposed at an acute angle $\alpha$ (See FIGS. 1A and 2A) of between about 50 to 70 degrees with respect to a principal axis of the hub 110.

Figure 2A:
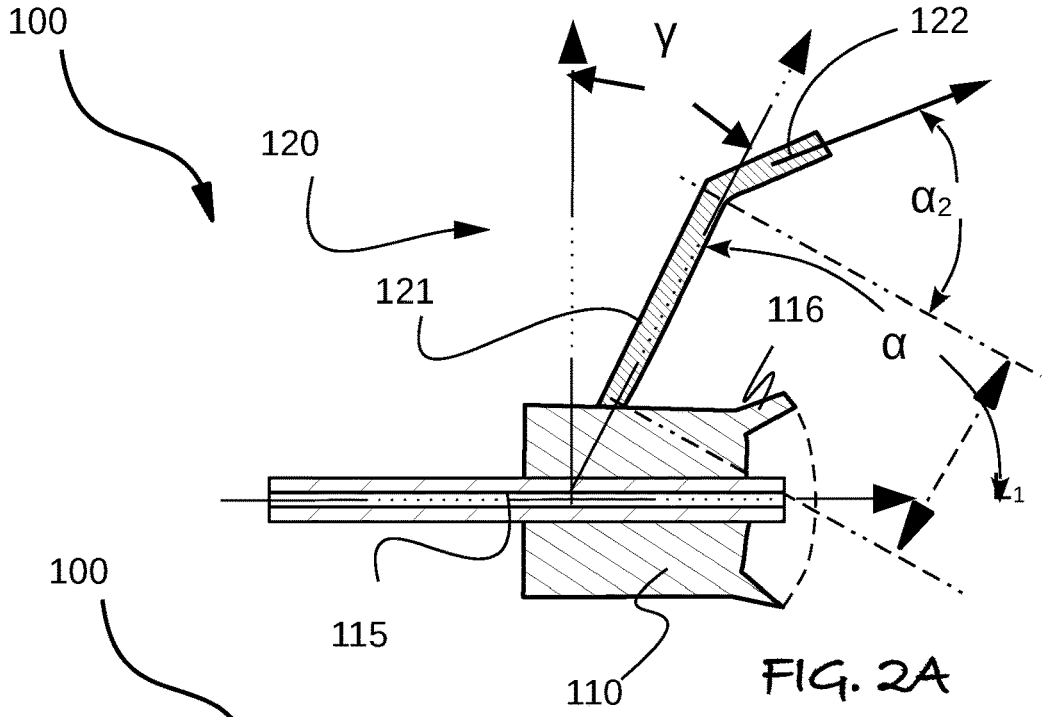

The blades 120 may be set at a rake angle $\gamma$ (defined between the normal to the hub 110 exterior surface as shown in FIGS. 1A and 2A)) to a cord center 124 centered of each blade 120 is preferably about 25-35 degrees (=an acute angle of 55 to 65 degrees).

The blades 120 may be affixed to the hub 110 at twist angle δ (from the principal axis of the hub 110 or central axis C as shown in FIG. 1A) of about 30 to 40 degrees, but more preferably about 33 degrees.

The length L2 of the second portion 122 of each blade 120 may be at least 40 to 60% of the length L1 of the first portion 121 of the blades 120. The acute angle $\alpha_2$ of the second portion may be less than the acute angle α of the first portion. The angle β between first portion 121 and second portion 122 may preferably be about 45 degrees (to give a compound rake angle of the second portion that is preferably about 70 degrees). Further, the directed thrust propulsion system 100 may have 3, 4 or more blades 120

Figure 2B:
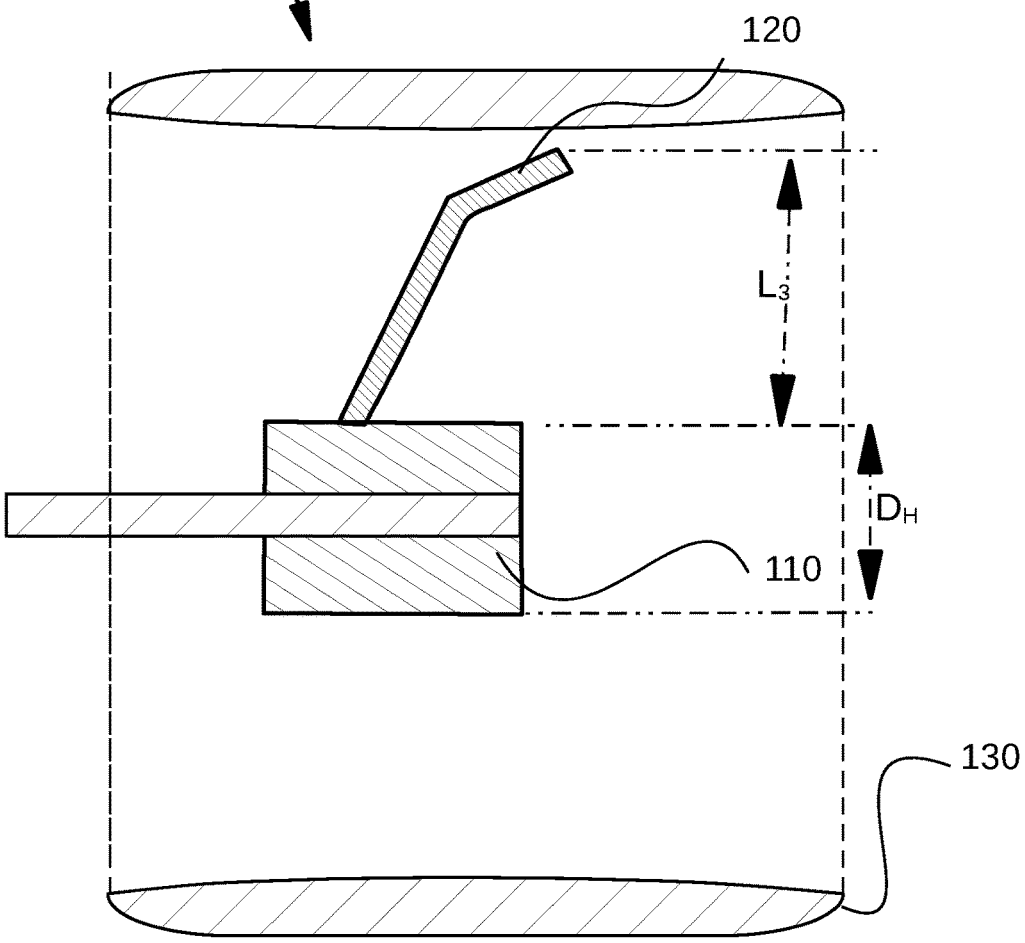
FIG. 2B is a cross-sectional elevation through the central axis of the hub and a blade central axis for another embodiment of the propulsion system.
Figure 3:
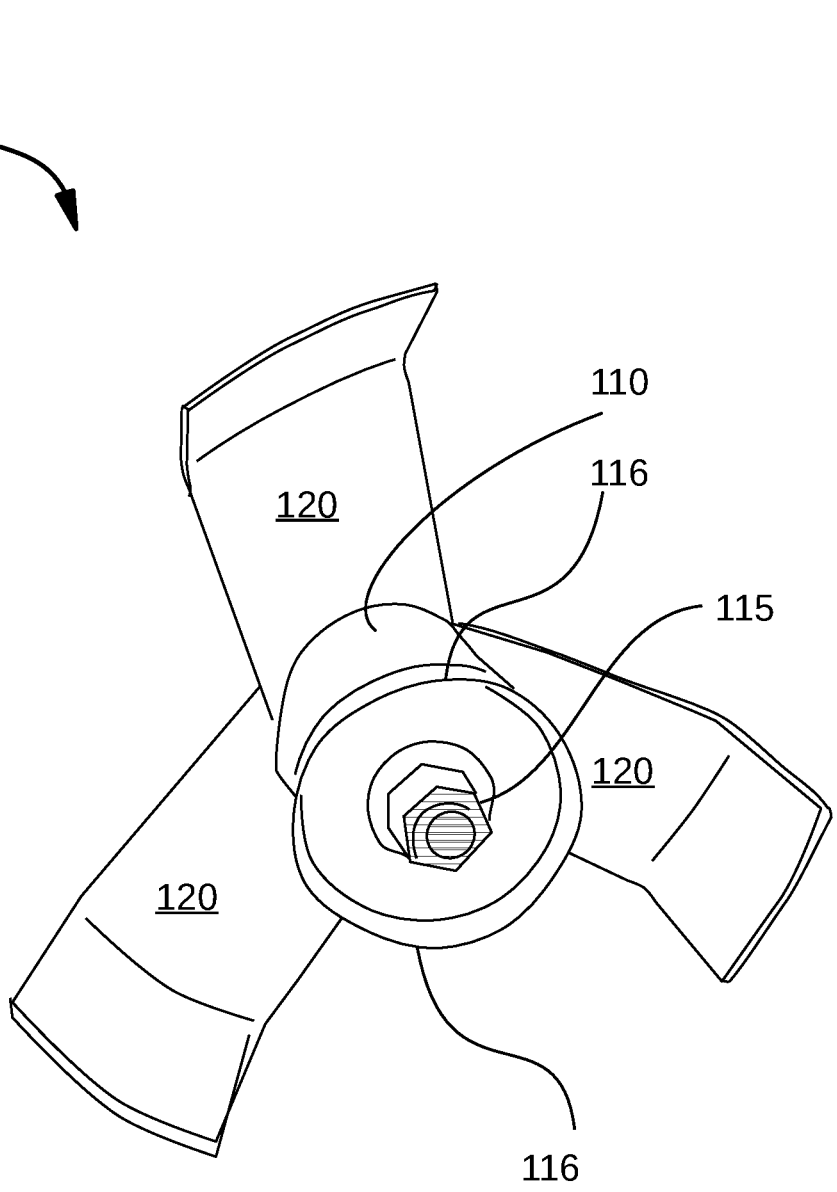
FIG. 3 is a perspective view of the exterior end of the propulsion system in FIG. 1A-C.

In a preferred embodiment in FIG. 2B, an annular nozzle 130 configured to extend over the rotary path of the blades 120 at least along the projected length of the blade 120 on the hub 110, that is the annular nozzle has an inner diameter greater than the projected diameter $D_p$ spanned by the hub 110 and the blades 120.

Preferred dimensions of some embodiments of the system may have the following dimensions. A blade width $W_B$ of about 75.00 mm (3.00 inches), a Length $L_1$ of first portion 121 of about 105.00 mm (4.13 inches) and a Length $L_2$ of second portion of about 50 mm (2 inches). Concave side 123 of each blade 120 for these blade lengths blades may have a radius of curvature 2820.50 mm (111.04 inches). The projected diameter $D_p$ spanned by the hub 110 and the blades 120 is preferably about 250 mm (10 inches). The projected distance L3 from a blade 120 tip to hub perimeter 110*p* may be preferably about 125 mm (5 inches).

In scaling the directed thrust propulsion system 100 to larger or smaller vessel the following ratios of dimension may be preferable, with absolute sizes depending on the vessel size and the number of propulsion systems 100 deployed thereon:

The blade width ($W_B$) to the radius of curvature of the cylindrical portion of the blades 120 is between about 30 to 40.

The blade width ($W_B$) of the blade is 50 to 110% of the hub diameter ($D_H$). The blade width ($W_B$) to hub diameter ($D_H$) is more preferably between about 0.70 to 1.30, but most preferably about 1.0

The hub diameter $D_H$ to projected blade diameter is preferably between about 2.33 and 4.33, but more preferably about 3.33

The blade length ($L_1$) to blade width ($W_B$) in the first portion 121 may be preferably between about 0.98 to 1.82, but more preferably about 1.40

The blade length ($L_2$) to blade width ($W_B$) in second portion may be preferably between about 0.47 to 0.87, but more preferably about 0.67

The directed thrust propulsion system 100 when used on an outboard motor may have a central exhaust channel 115 within the hub 110, with the hub distal end 116 tapering outward adjacent to the outlet of the central exhaust channel 115, which are illustrated schematically in FIG. 1A-B, 2A, 3-4. A watercraft may utilize a plurality of the novel directed thrust propulsion systems 100.

Figure 4:
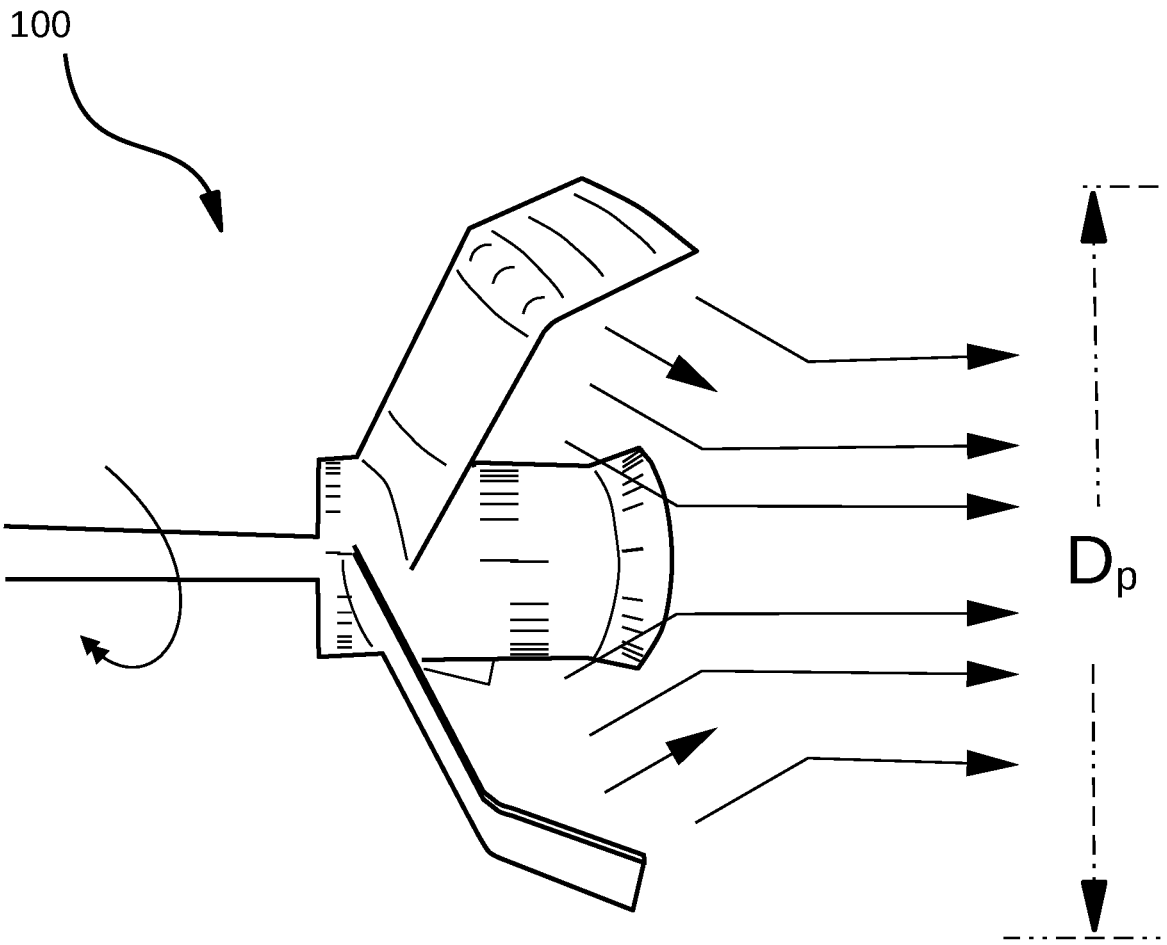
FIG. 4 is a schematic is an exterior side elevation view of the propulsion system with rightward pointing arrows illustrating the direction of fluid flow that generate thrust when the hub is rotated.

Further, as illustrated by the arrows pointing to the right in FIG. 4, the thrust is directed inward by the blades second portion 122, while the blades first portions 121 direct the thrust parallel to the central axis C so the resulting thrust is directed rearward without expanding angularly beyond the projected diameter $D_p$ spanned by the hub 110 and the blades 120.

While the various innovations have been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

I claim:

1. A directed thrust propulsion system for water propulsion, the directed thrust propulsion system comprising:

a. a generally cylindrical hub having a first principal axis that is configured to be coupled in rotary engagement with a drive shaft turned by a motor, b. a plurality of blades attached to extend in a radial direction away from said cylindrical hub, c. each blade having a first portion attached directly to said cylindrical hub and then terminating at a second portion coupled to the first portion, d. in which the first and second portions are entirely shaped as sections of a cylinder in having a concave side is tilted at an acute angle with respect to the first principal axis such that the first principal axis faces a concave side of the first and second cylindrical portions.

2. The directed thrust propulsion system for water propulsion according to claim 1 further comprising an annular nozzle configured to extend over a rotary path of the blades at least along a projected length of the blade on said hub.

3. The directed thrust propulsion system for water propulsion according to claim 1 in which the acute angle of the first portion of each blade is between about 50 to 70 degrees.

4. The directed thrust propulsion system for water propulsion according to claim 2 in which the acute angle of the second portion is less than the acute angle of the first portion.

5. The directed thrust propulsion system for water propulsion according to claim 1 in which the second portion has a length that is at least about 40 to 60% of the length of the first portion.

6. The directed thrust propulsion system for water propulsion according to claim 1 in which blade twist angle is between about 30 to 40 degrees.

7. The directed thrust propulsion system for water propulsion according to claim 1 in which at least one of the first and second cylindrical portion of the blades has a radius of curvature that is between about 2,000 to 3,000 mm.

8. The directed thrust propulsion system for water propulsion according to claim 1 in which the radius of curvature of the first and second cylindrical portions have a radius of curvature that are substantially the same.

9. The directed thrust propulsion system for water propulsion according to claim 1 in which a ratio of blade width to a radius of curvature of one of the first and second cylindrical portion of the blades is between about 30 to 40.

* * * * *